US011761617B2

(12) United States Patent
Killion et al.

(10) Patent No.: US 11,761,617 B2
(45) Date of Patent: Sep. 19, 2023

(54) ELECTRICAL DEVICE HAVING A MAINTAINED ON OFF SWITCH

(71) Applicant: Thomas Killion, Indianapolis, IN (US)

(72) Inventors: Thomas Killion, Indianapolis, IN (US); Samuel Werth, Indianapolis, IN (US)

(73) Assignee: Thomas Killion, Indianapolis, IN (US)

( * ) Notice: Subject to any disclaimer, the term of this patent is extended or adjusted under 35 U.S.C. 154(b) by 0 days.

(21) Appl. No.: 17/331,447

(22) Filed: May 26, 2021

(65) Prior Publication Data

US 2021/0372605 A1 Dec. 2, 2021

Related U.S. Application Data

(60) Provisional application No. 63/030,354, filed on May 27, 2020.

(51) Int. Cl.

| | |
|---|---|
| ***F21V 23/04*** | (2006.01) |
| ***F21L 4/00*** | (2006.01) |
| ***H01H 13/48*** | (2006.01) |
| ***H01H 13/68*** | (2006.01) |
| ***F21Y 115/10*** | (2016.01) |

(52) U.S. Cl.

CPC ..... *F21V 23/0414* (2013.01); *F21L 4/005* (2013.01); *F21V 23/0428* (2013.01); *H01H 13/48* (2013.01); *H01H 13/68* (2013.01); *F21Y 2115/10* (2016.08)

(58) Field of Classification Search

CPC .. F21V 23/0414; F21V 23/0428; F21L 4/005; H01H 13/48; H01H 13/68; H01H 2215/016

See application file for complete search history.

(56) References Cited

U.S. PATENT DOCUMENTS

| | | | |
|---|---|---|---|
| 4,399,495 | A | 8/1983 | Leopoldi et al. |
| D376,690 | S | 12/1996 | Lockerby |
| D425,231 | S | 5/2000 | Lynch et al. |
| 6,132,064 | A | 10/2000 | Bear |
| 6,301,484 | B1 | 10/2001 | Rogers et al. |
| 6,435,695 | B1 | 8/2002 | Altman |
| 6,454,435 | B1 | 9/2002 | Altman |

(Continued)

FOREIGN PATENT DOCUMENTS

EP 0395779 A1 * 11/1990

*Primary Examiner* — Erin Kryukova

(74) *Attorney, Agent, or Firm* — Indiano Law Group LLC; E. Victor Indiano; John T. Woods

(57) ABSTRACT

An electrical device, such as a flashlight includes an on-off switch that is movable between a maintained actuated position and a maintained unactuated position. The device has a body containing an electrical assembly that includes a power source, a switch, and an actuated member, such as a light. The switch includes a first conductor attachable to a first terminal of the power source. The switch member includes a switch portion that has a generally sheet-like portion that is disposed adjacent to the second terminal of the power source. The sheet-like portion includes a deformable central portion surrounded by a retained perimeter. The deformable portion is movable between a maintainable actuated position wherein it contacts the second terminal of the power source, and a maintained unactuated position wherein it is spatially separated from, and not in contact with, the second terminal of power source

15 Claims, 9 Drawing Sheets

(56) References Cited

U.S. PATENT DOCUMENTS

| | | | | |
|---|---|---|---|---|
| 6,626,019 | B1 | 9/2003 | Huang | |
| 6,773,191 | B2 | 8/2004 | Killion | |
| D524,972 | S | 7/2006 | Shiu | |
| 7,147,344 | B2 | 12/2006 | Parsons | |
| D549,862 | S | 8/2007 | Lee | |
| 7,448,816 | B2 | 11/2008 | Killion | |
| 7,499,699 | B2 | 3/2009 | Rodriguez et al. | |
| D627,092 | S | 11/2010 | Puglisi | |
| D636,509 | S | 4/2011 | Killion et al. | |
| D636,510 | S | 4/2011 | Killion et al. | |
| 8,100,598 | B2 | 1/2012 | Killion et al. | |
| D715,473 | S | 10/2014 | Killion et al. | |
| 9,228,703 | B2 | 1/2016 | Killiion | |
| D777,362 | S | 1/2017 | Killion | |
| 9,583,028 | B2 | 2/2017 | Killion et al. | |
| D824,061 | S | 7/2018 | Killion | |
| 2003/0081416 | A1 | 5/2003 | Hsu | |
| 2006/0176685 | A1* | 8/2006 | Galli | F21L 4/005 362/157 |
| 2007/0190995 | A1 | 8/2007 | Wang et al. | |
| 2009/0152081 | A1* | 6/2009 | Sharrah | H01H 13/48 362/205 |
| 2010/0110670 | A1 | 5/2010 | Werth et al. | |
| 2013/0215608 | A1* | 8/2013 | Killion | F21L 4/005 362/198 |
| 2016/0153646 | A1* | 6/2016 | Maglica | F21V 29/503 362/208 |
| 2021/0110984 | A1* | 4/2021 | Gauthier | H01H 11/0056 |

* cited by examiner

ELECTRICAL DEVICE HAVING A MAINTAINED ON OFF SWITCH

PRIORITY DATA

The instant application claims benefit of priority to Thomas Killion and Sam Werth U.S. Provisional Patent Application Ser. No. 63/030,354 that was filed on 27 May 2020, and which is fully incorporated herein by reference.

I. TECHNICAL FIELD THE OF INVENTION

The present invention relates to switches for use in electrical objects to turn their objects on and off, and more particularly, to a maintained switch that is usable to provide a maintained off and maintained on position for the device.

II. BACKGROUND

On-Off switches are used with electrical devices having electronically powered member such as lights, buzzers, speakers, motors, timers, etc. for many years. Most on-off switches are "maintained on" and "maintained off" switches so that the user can place the switch in either a maintained on or maintained off position by actuating a switch such as by pushing a button, and then releasing the button, while the switch remains actuated.

Even though the user disengages from having contact with the switch, it will remain in its off or on position, thus turning on the device to which it is coupled for a maintained period of time. Eventually, the user will re-actuate the switch such as by pushing the button again to move it from the current condition (e.g. on) to the other position (e.g. off) and turned off, the switch ill remain in the off position until reactivated.

Another type of switch that exists is known as a "momentary" switch. A momentary switch is biased in one position (usually off), but can be actuated into the on position by the user engaging the switch. To maintain the switch in its on position, the user must maintain contact with the switch for the entire duration of the time that the user desires the device to stay in the actuated position. When the user disengages contact from the switch, the switch is biased automatically to move the device from its on position to its off position (for devices that are biased to be normally in the off position).

One place where such momentary switches are used are products wherein the cost of the switch becomes a significant factor in determining the economic viability of the device. For example, very low-cost flashlights are available that are sufficiently inexpensive so that they can be economically disposed of after their battery becomes exhausted. Often, such flashlights are so inexpensive that new flashlights can be purchased at retail for less money than the cost of purchasing a battery for the old flashlight and inserting it into the device.

Such low-cost devices exist with both maintained position on-off switches and momentary on-office switches. As a general rule, the maintained on/off switches are preferred because they provide more versatility for the flashlight. Although flashlights are used as exemplary devices in which the switch of the present invention has utility in a wide variety of devices that employ on-off switches, and especially low cost and one-use or disposable devices.

For example, the user who desires to employ a maintained on-off flashlight can actuate the switch to turn the flashlight on, and then place the flashlight upon a surface, such as a countertop, while directing the light beam in the appropriate direction. By doing so, the user will have both hands free to perform whatever operation the user desires to perform in the area lighted by the beam of the flashlight.

However, maintained on and off switches for use in low-cost flashlights have some disadvantages that detract from their usefulness. First, the maintained on-off switches are relatively expensive and difficult to construct. Although such on-off switches can be made to be rather small and inexpensive, they usually require being coupled to some sort of substrate, such as a board, that serves to hold the switch in a proper place. Further, they must be coupled to some sort of circuitry to control the operation of the on-off switch.

Also, currently known maintained on-off devices require circuitry that is coupled to a switch. The circuitry provides minuscule amounts of current to the switch to keep the switch actuated. Although this minuscule amount of current does not drain the battery significantly, it still drains the battery to a noticeable extent. This drain is enough to reduce the useful life of the battery when compared to a switching device that does not require this minuscule current, such as a momentary switch.

Additionally, the combination of a board and switch requires that the flashlight have a relatively thickened profile. The board thickens the profile of the device, such as the flashlight. In applications where one seeks to have a very thin product, such as the SMASH LIGHTS sold by the Killian Corporation, the assignee of the present invention, the thickened profile provided by a board-containing switch detracts from the aesthetics of the device.

One object of the present invention is to provide an electrical device, such as a flashlight, that includes a maintained on-off switch, which can be manufactured at an economically acceptable cost, and which has a low profile so as to not unduly thicken or require additional depth to the device into which it is inserted.

III. SUMMARY OF THE INVENTION

In accordance with the present invention, an electrical device is movable between an actuated or "on" position, and an unactuated or "off" position. The device includes a body that contains electrical components including a power source, a switch, and an actuated member such as a bulb. The switch includes a first conductor attachable to a first terminal of the power source, and a switch containing second conductor coupled to a second terminal of the power source. The switch containing second conductor includes a switch portion having a generally sheet-like portion that is disposed adjacent to the second terminal of the power source. The sheet-like portion includes a deformable central portion surrounded by a retained perimeter. The deformable portion is movable between an actuated position wherein it contacts the second terminal of the power source and an unactuated position wherein it is spatially separated and not in contact with the second terminal of the power source.

IV. BRIEF DESCRIPTION OF THE DRAWINGS

Figure 1:
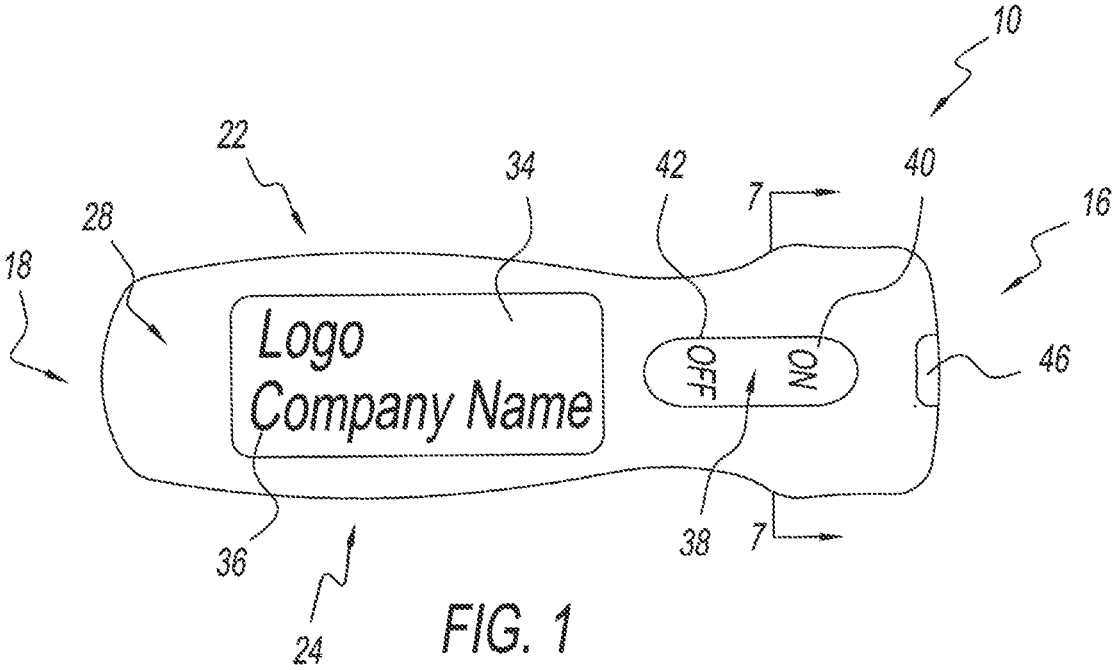
FIG. 1 is a top view of an electrical device, such as flashlight that contains the inventive switch of the present invention.
Figure 4A:
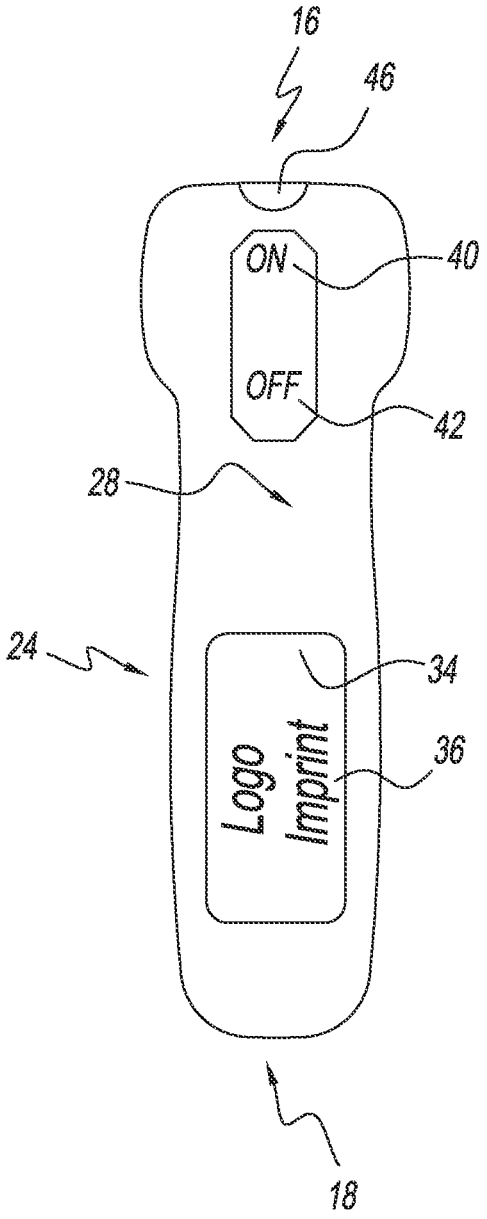
Figure 4B:
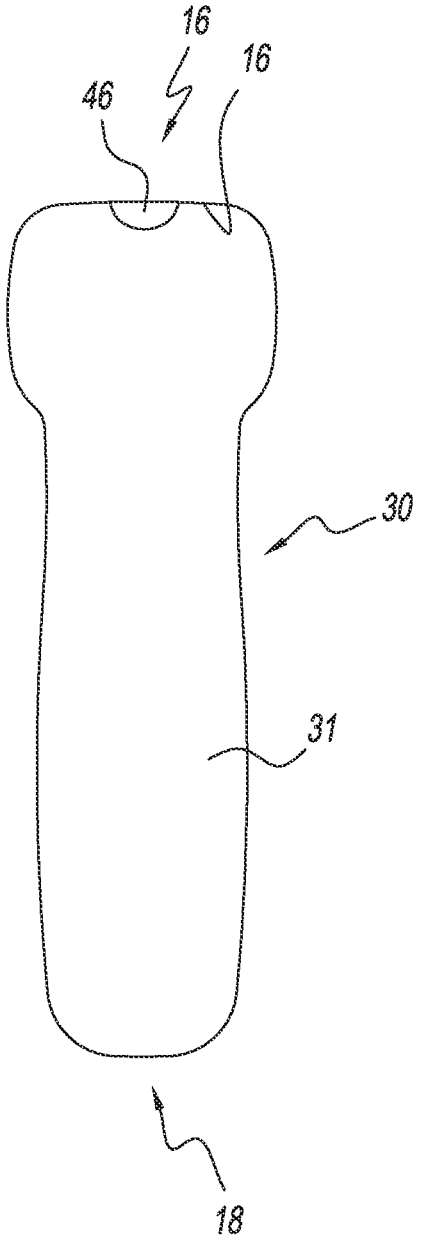
Figure 4C:
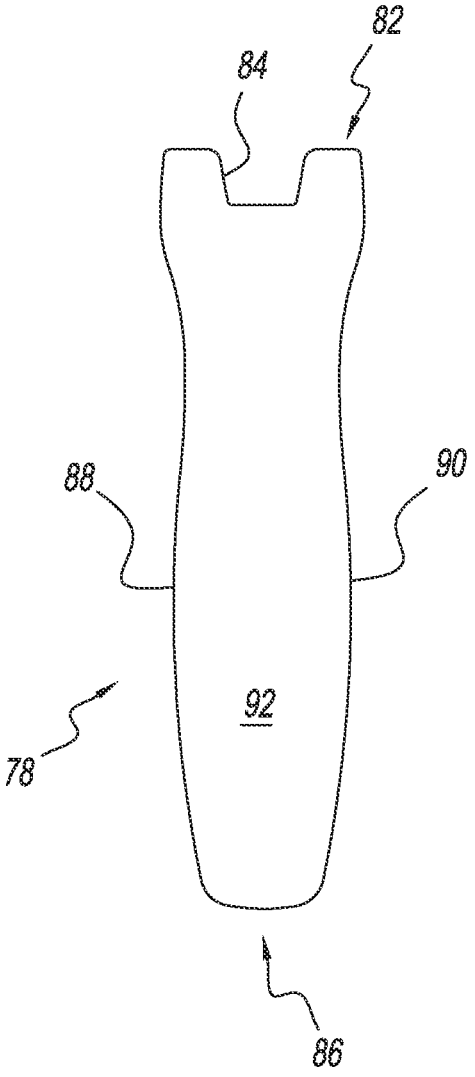
Figure 4D:
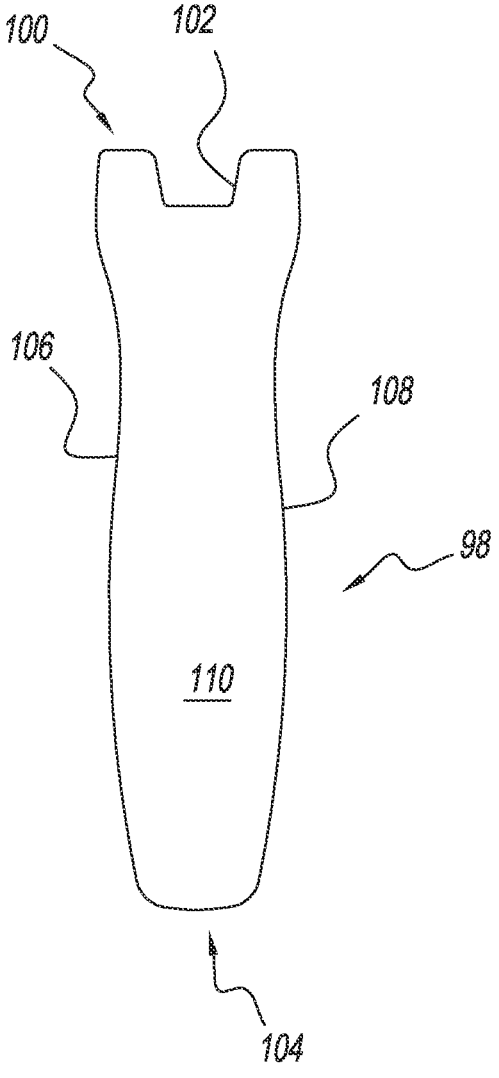
Figure 4E:
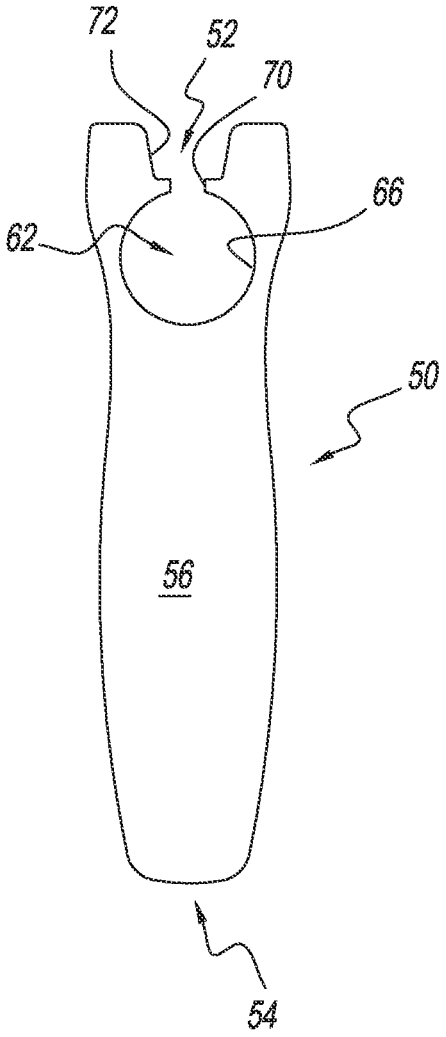
Figure 4F:
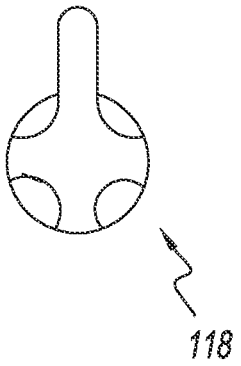
Figure 5:
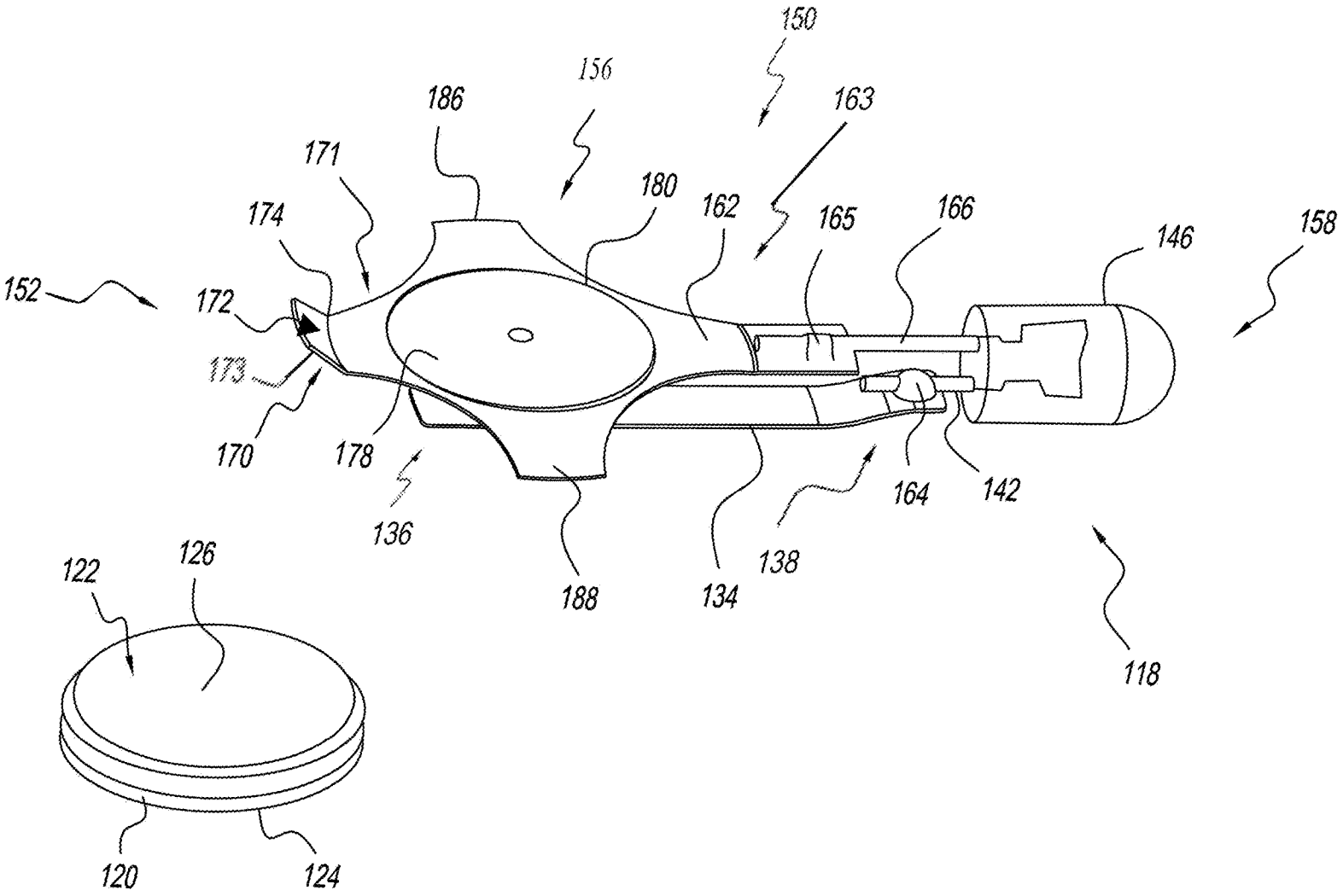
Figure 6:
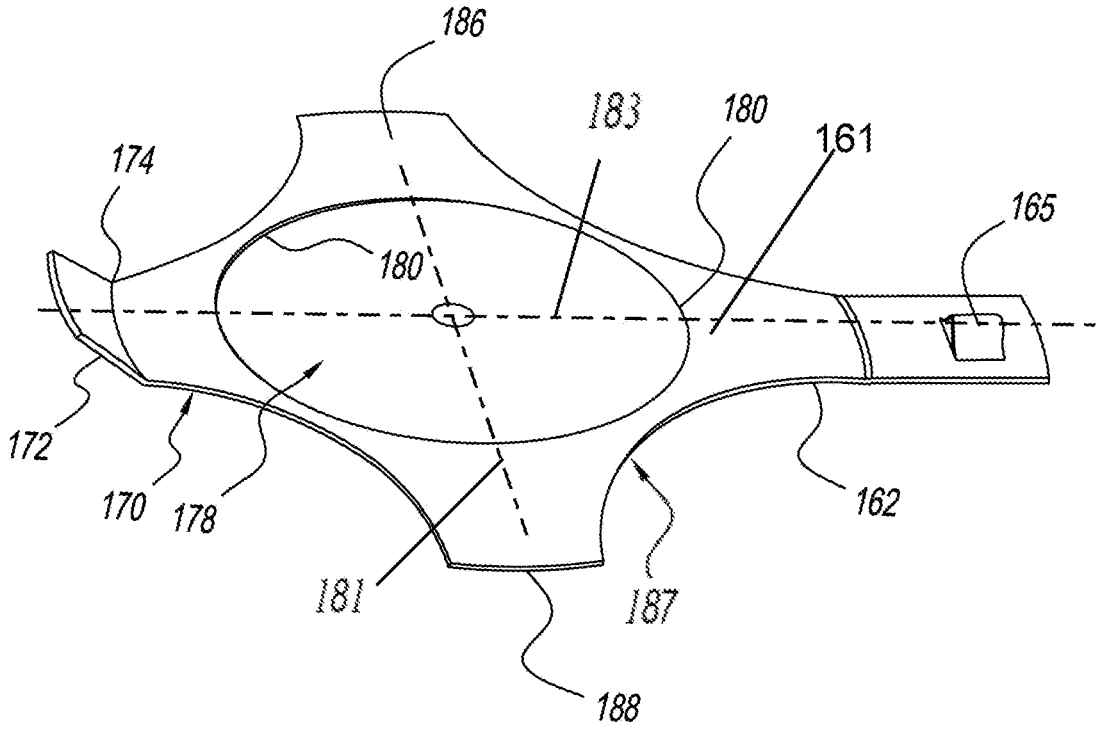
Figure 7:
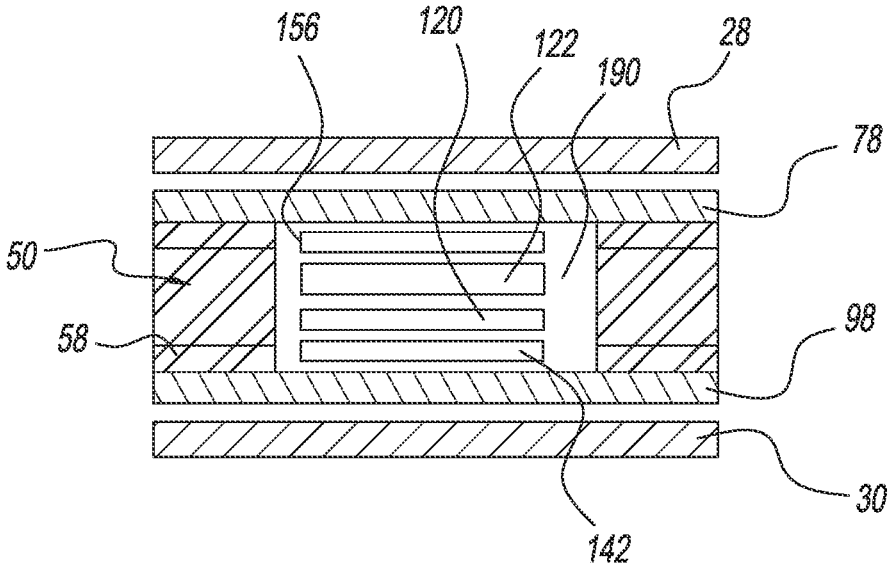
Figure 8:
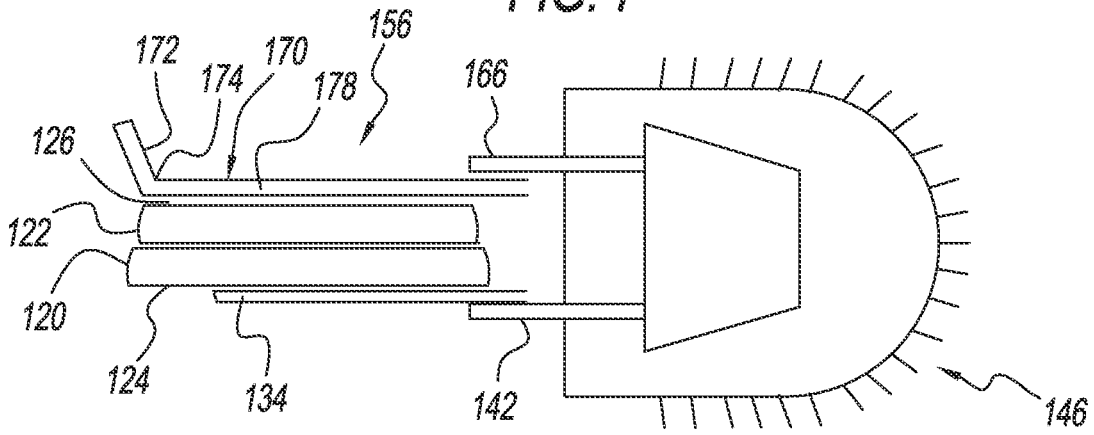
Figure 9:
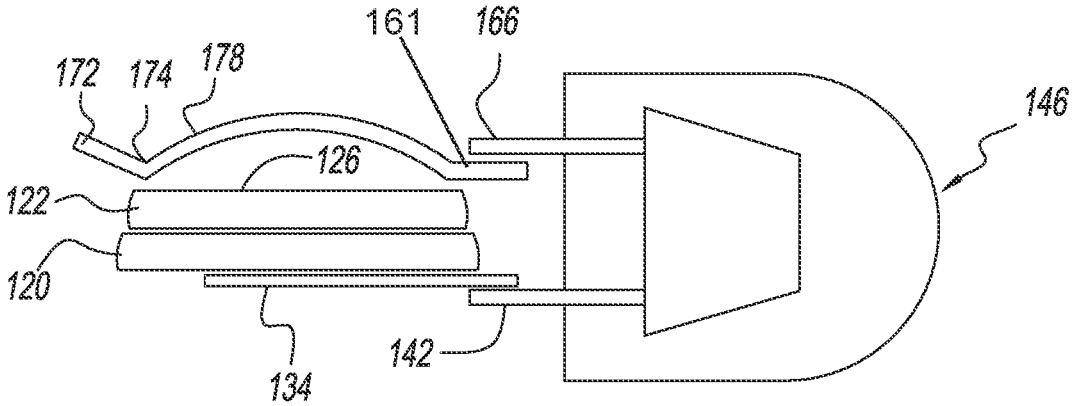
Figure 10:
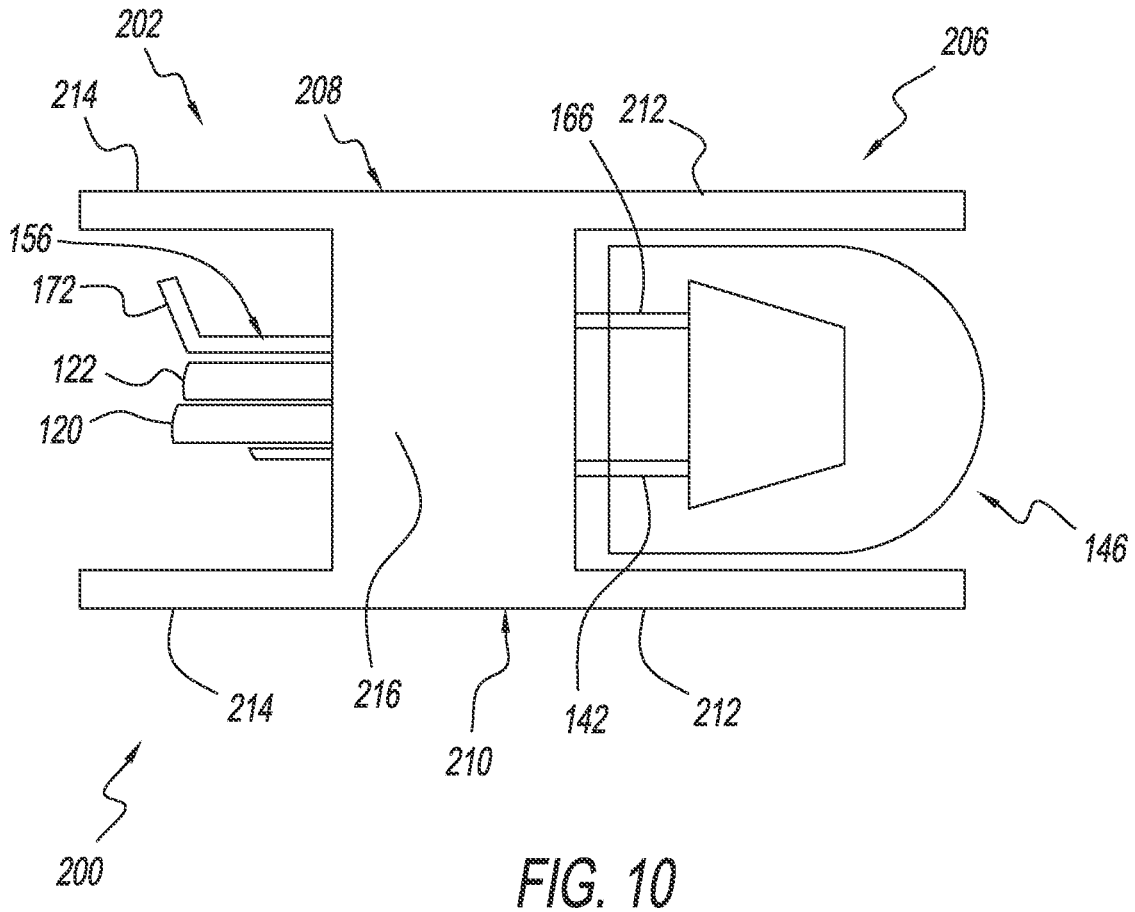
Figure 11:
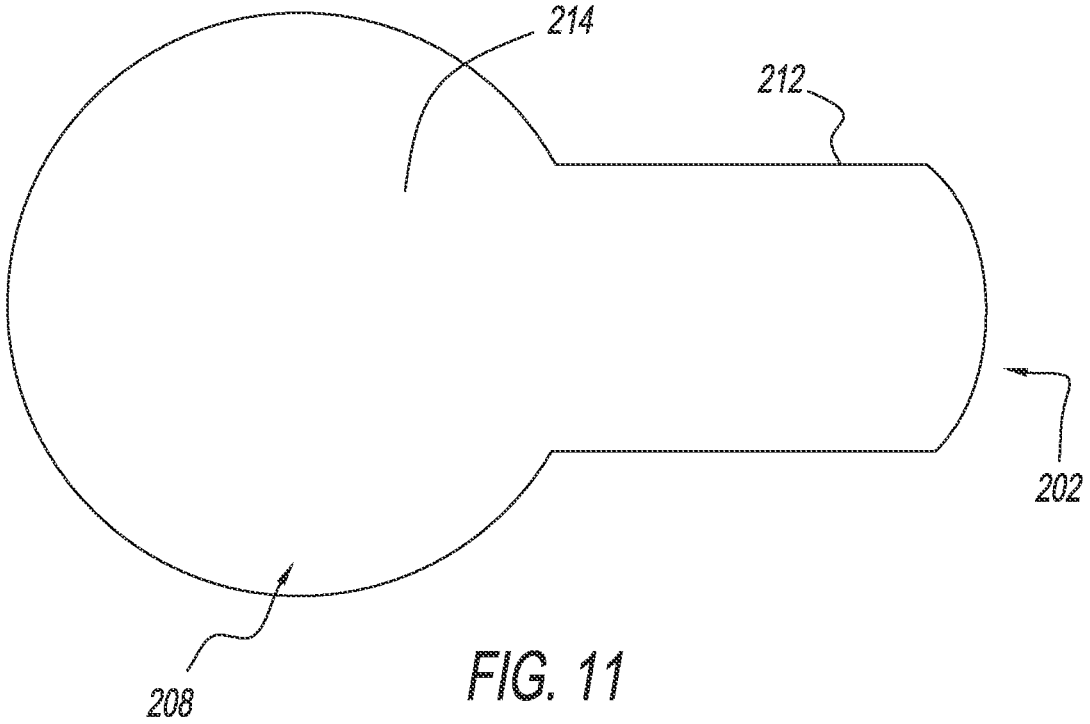
Figure 12:
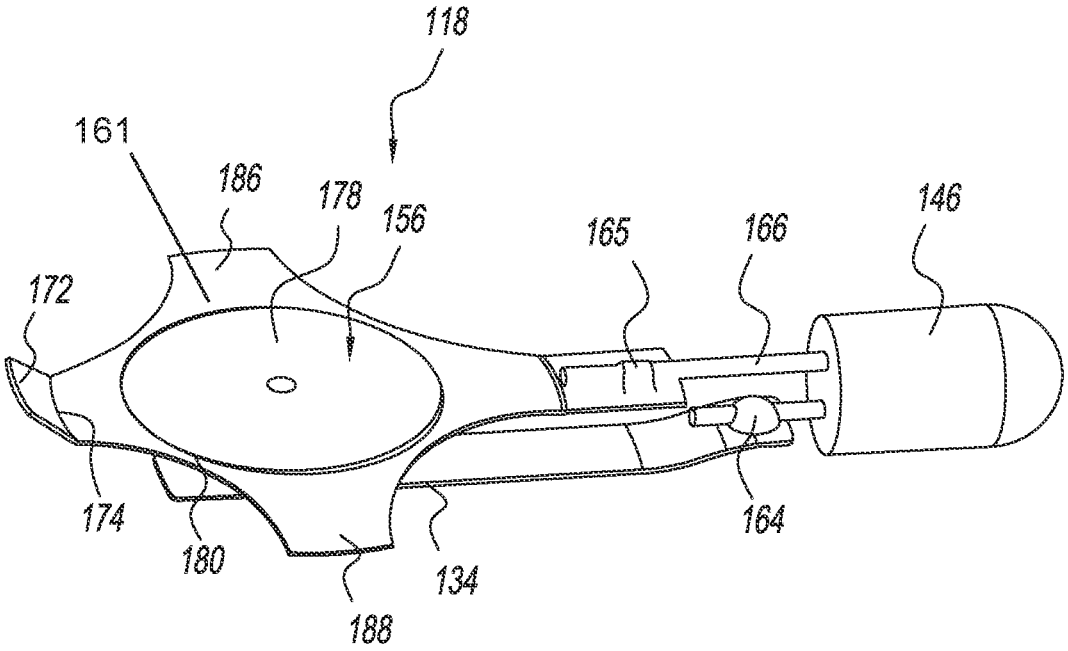
Figure 13:
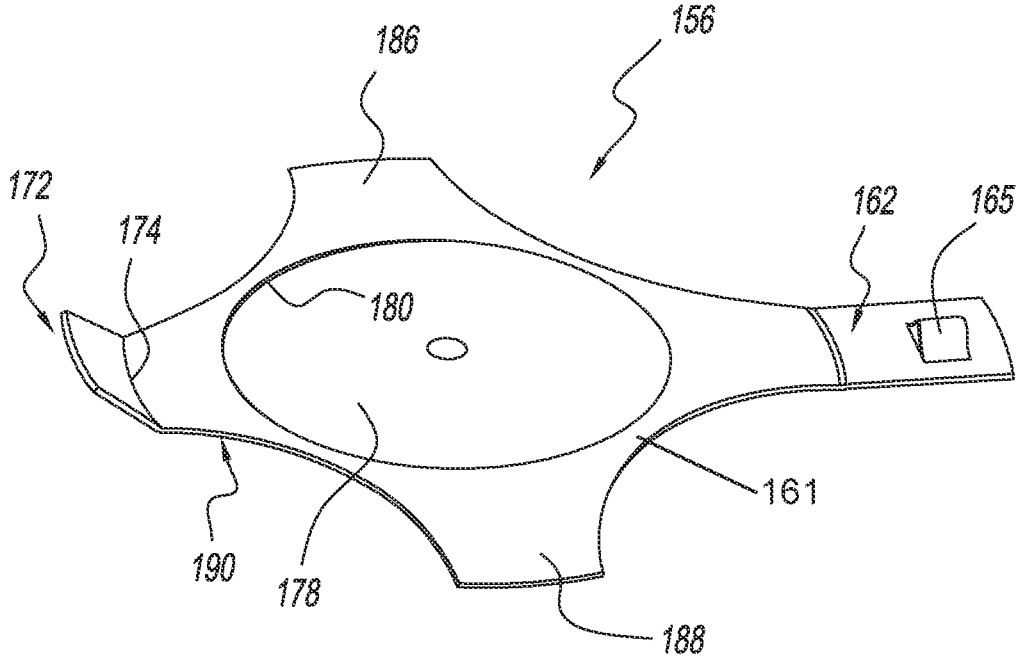

FIGS. 4A-4F comprise an exploded view of the components of the flashlight of the present invention, wherein:

FIG. 4A shows a top view of a first cover member of the present invention;

FIG. 4B shows a bottom view of a second cover of the flashlight of the present invention;

FIG. 4C shows a top view of the first stiffening member of the present invention;

FIG. 4D shows a bottom view of the second stiffening member;

FIG. 4E shows a top view of a core member of the present invention;

FIG. 4F shows a top view of the electrical assembly of the present invention;

FIG. 5 shows a perspective exploded view of the electrical assembly of the present invention;

FIG. 6 shows a perspective view of the switch of the flashlight;

FIG. 7 shows a side sectional view of the flashlight of the present invention taken generally along lines 7-7 of FIG. 1;

FIG. 8 is an enlarged side view of the electrical assembly of the present invention showing the switch in the "on" or actuated position to illuminate the light bulb;

FIG. 9 is an enlarged large side view of the electrical assembly of the present invention showing the switch in the de-actuated position to cause the light bulb to not be illuminated;

FIG. 10 is a side view of an alternate embodiment electrical assembly having a cover member disposed above and beneath the switch and light member;

FIG. 11 is a top view of the electrical assembly of FIG. 10;

FIG. 12 is another perspective view of the electrical assembly of the present invention with the batteries removed; and FIG. 13 is a perspective view of the switch member of the present invention.

V. DETAILED DESCRIPTION

The description that follows describes, illustrates and exemplifies one or more particular embodiments of the present invention in accordance with its principles. This description is not provided to limit the invention to the embodiment or embodiments described herein, but rather to explain and teach the principles of the invention in such a way to enable one of ordinary skill in the art to understand these principles and, with that understanding, be able to apply them to practice not only the embodiment or embodiments described herein, but also other embodiments that may come to mind in accordance with these principles.

The scope of the present invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing reference numbers, such as, for example, in cases where such labeling facilitates a clearer description. Additionally, the drawings set forth herein are not necessarily drawn to scale, and in some instances proportions may have been exaggerated to more clearly depict certain features. Such labeling and drawing practices do not necessarily implicate an underlying substantive purpose.

Also, certain directional terms, such as top, bottom, axial, radial, upper, lower, proximal, distal, outwardly, inwardly, upwardly, and downwardly as used generally as terms of illustration rather than limitations, whose purpose is to more fully describe the preferred embodiment shown herein, rather than to limit the scope of coverage of the claims.

Furthermore, certain views are side views which depict only one side of the device (or one set of components of a multi set array of components), but it will be understood that the opposite side and other component sets are preferably identical thereto. The present specification is intended to be taken as a whole and interpreted in accordance with the principles of the present invention as taught herein and understood by one of ordinary skill in the art.

The present invention comprises an electrical device 10 that has an electrically powered member and a novel switch mechanism. Although the novel switch member assembly 150, including switch member 156, of the present application is depicted as being employed in a flashlight 10, it is contemplated that the switch member assembly 150 can be employed in a variety of electrical devices 10.

Figure 2:
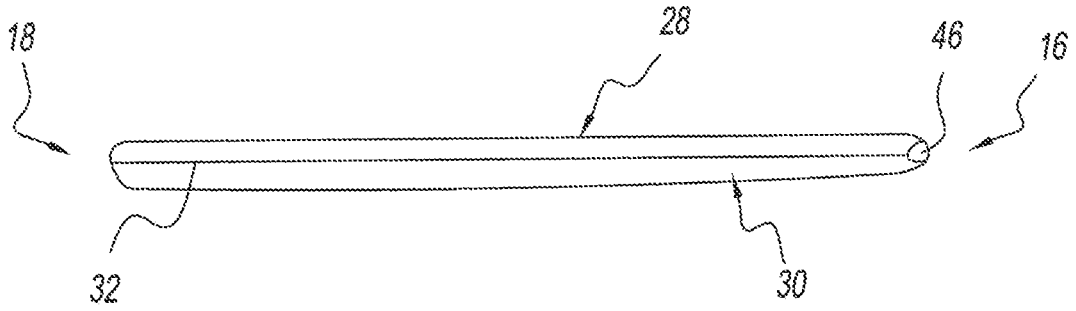
FIG. 2 is a side view of the flashlight.

The flashlight 10 includes a first end 16 that contains a light, a second end 18 that comprises a handle portion, a first side 22 and a second side 24. As shown in FIG. 2, the flashlight 10 is a rather thin, flat flashlight 10 that has a substantially greater length than it does width and a substantially greater length and width than it does depth (thickness). The first and second sides 22, 24 are comprised of seams wherein an exterior top cover 28 is joined to a bottom cover 30.

Preferably, the top and bottom covers 28, 30 are made from a plastic of a type that will accept ink printing and which is generally flexible in nature. The top and bottom covers 28, 30 are joined together by either a chemical or mechanical process which may include such techniques as glue or sonic welding. The side seam 32 extends generally around the perimeter of the two covers and is the point wherein the covers are joined.

The top cover 28 preferably includes an imprint portion 34 on which an imprinted term 36 can be provided. The imprint portion 34 is especially useful for products that are sold in the promotional products industry. Normally, the top and bottom covers 28, 30 are either made from an opaque plastic, or otherwise made from a clear plastic to which a surface coloring is applied that comprises an ink or paint-like material that causes the top and bottom covers 28, 30 to be generally opaque. As will be discussed in more detail below, a portion of the top 28 and bottom 30 covers may be left uncovered and clear, to provide a transparent portion 46 through which light from an interiorly disposed lightbulb can pass to the exterior of the flashlight 10.

The top cover 28 is designed to have a top exterior surface 37 and a bottom (interior) surface (not shown). The top surface 37 is large enough to have a significantly sized imprint portion 34 for receiving a readable and noticeable imprint term 36, while also providing room for an imprinted switch control 38 that includes an on portion 40 and an off portion 42. The bottom cover member 30 has generally the same size and shape as the top cover member 28 and includes a top (interior) surface 31 and a bottom (exterior) surface (not shown).

The relatively larger area top surface 28 is well-designed to receive an imprinted portion 34 containing imprint 36. If the flashlight is sold in the promotional products industry, the imprinted portion 34 will carry an imprinted message 36 such as the name and logo of a company that is not the manufacturer of the flashlight 10, but rather a company, such as a soft drink manufacturer or doctor's office, that is purchasing the flashlight to use as an advertising vehicle. Alternately, the imprinted portion 34 can contain an affinitybased imprint 36, such as a logo of a sports team, fraternity, industry group, geographic location, tourist attraction, or club logo, etc.

The important thing is not the particular logo that is printed on the imprinted portion 34, but rather the existence of the imprinted portion 34 having a relatively large surface area on which can be imprinted whatever is desired by the purchaser of the flashlight 10. The existence of this imprinted portion 34 enhances the value of the product within the promotional products and specialty advertising industry, as it provides a large surface on which the purchaser's logo or message can be imprinted, to thereby serve as an advertising and promotion vehicle for the particular customer.

As discussed above, the top cover 28 also includes an imprinted on-off switch portion 38 that includes an "on" portion 40 and an "off" portion 42. To turn the flashlight 10 on and off, the user presses downwardly on the respective on 40 or off 42 portion which engages the switch member 156 that is disposed under the top cover 28 within the interior of the flashlight 10, to turn the flashlight 10 light bulb 146 on and off.

The placement of the on portion 40 and off portion 42 is important as they should be placed in a position, relative to the switch member 156 of the switch member assembly 150, so that pressing the top cover 28 on the on portion will cause the switch to move from an off position to an on position to make electrical contact between the power source 120, 122 and the light bulb 146, so that the light will shine and the flashlight 10 will be turned "on". Similarly, the off portion 42 should be positioned so that pressing on the off portion 42 causes the switch member 156 to move to where it becomes disconnected from either the lightbulb 146 or battery 120, 122 to open the circuit to thereby prevent current from flowing from the battery to the lightbulb 146, to thereby cause the lightbulb 146 to be turned off.

Along with the switch member 156, the lightbulb 146 is contained within the interior of the top and bottom covers 28, 30. A transparent portion 46 is provided at the forward first end of the top cover 28 and the bottom cover 30 to enable light to pass from the lightbulb 146 through the covers 28, 30 and outwardly so that the beam of light may provide illumination.

Figure 3:
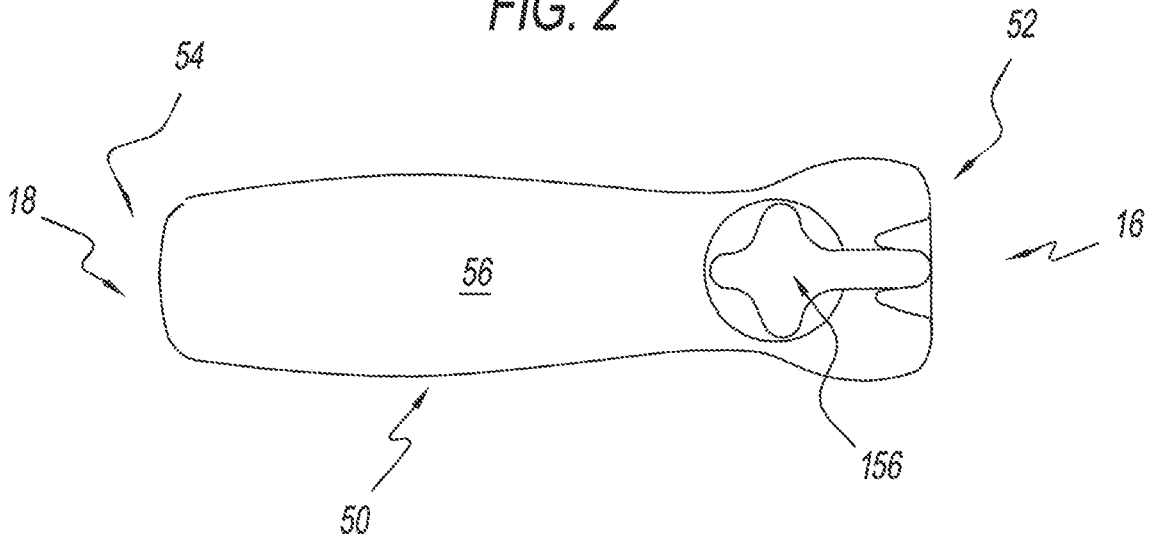
FIG. 3 is a view of a core member and switch member of the flashlight, the cover of the flashlight being removed.

As best shown in FIGS. 3, 4*e*, and 4*f*, a core member 50 resides in the central part of the interior cavity formed by the top and bottom cover members 28, 30. Core member 50 preferably comprises a thickened, foam-type core which may have a thickness of about 0.25 inches.

The core member 50 includes a first end 52, that is disposed adjacent to the first end 16 of the flashlight 10, and a second end 54 that is disposed adjacent to the second end 18 of the flashlight 10. The core member 50 also includes a generally planar top surface 56, and a generally planar bottom surface 58.

An electrical assembly receiving portion 62 is best shown at FIG. 4*e* and is disposed adjacent to the first (or distal end) end 52 of the core member 50. The electrical assembly receiving portion 62 comprises a cut-out portion of the core member 50 and includes a proximally disposed, generally disc-shaped receiving portion 66. A neck portion 70 having a reduced width is disposed relatively distally of the proximally disposed switch and battery receiving portion 66.

A distally disposed lightbulb 146 receiving portion 72 is disposed distally of both the switch and battery receiving portion 66 and the neck portion 70. As will be discussed in more detail below, the proximally disposed disc-shaped switch and battery receiving portion 66 is sized and configured for receiving the switch 156 and battery 120, 122. The distally disposed lightbulb 146 receiving portion 72 is sized and configured for receiving a lightbulb 146.

The neck portion 70 is sized for receiving conductors 134, 166 which extend between the battery 120 and switch member 156 that are disposed in the receiving portion 66, and the lightbulb 146 that is received in the distally disposed light receiving portion 72. It should also be noted that the light receiving portion 72 includes no distal end material so that light generated from the lightbulb has an open path between the lightbulb 146 to the transparent portion 46 of the cover member, so that light from the lightbulb 146 can pass outwardly of the cover of the flashlight 10.

As best shown in FIGS. 4*c* and 4*d*, a first stiffening member 78 and a second stiffening member 98 are provided, that are generally identical in configuration. The first stiffening member includes a first end portion 82 that is disposed adjacent to the first end 16 of the flashlight 10. The first end portion 82 includes area 84 for receiving the lightbulb of the light and switch assembly. The first stiffening member 78 also includes a second, or proximal end 86, a left side 88 and a right side 90. When assembled, the first stiffening member 78 is disposed between the top surface 56 of the core member and the interior lower surface of the top cover 78.

The second stiffening member 98 includes a first end 100 having a carved-out portion 102 that is generally similar to the area 84 of the first stiffening member 78. The second stiffening member 98 also includes a second, or distal, end 104 that is disposed adjacent to the proximal end 18 of the flashlight 10. The second stiffening member 98 also includes a first side 108, and a second side 109, a top surface 110, and a bottom surface 112.

When positioned in the flashlight, the second stiffening member 98 is disposed so that its top surface 110 is placed adjacent to the bottom surface 58 of the core member so that the bottom surface 58 of the core member 50 is disposed adjacent to the interior surface of the bottom cover member 30. The stiffening members 78, 98, generally comprise thin, flexible plastic sheets and overlay the top and bottom surface of the core member 50. The first and second stiffening members 78, 98, are designed to cover over the battery 120, 122 and switch member 156 portion of the electrical assembly 118, but not to cover over the lightbulb 146 portion of the electrical assembly 118. Preferably, the first and second stiffening member 78, 98, are adhesively coupled to the core member 50 by a suitable adhesive.

The electrical assembly 118 is best shown in FIGS. 4*f*-13, and includes a plurality of components, including batteries 120, 122, a switch member 156, an LED lightbulb 146, and various conductors to conduct electricity between the switch member 156, batteries 120, 122 and lightbulb 146.

The electrical assembly 118 includes a first 120 and second 122 batteries. The batteries 120, 122 are placed in series on top of each other. The battery pack that comprises the first 120 and second 122 batteries includes a first terminal 124 and a second terminal 126. Preferably, the first and second batteries 120, 122 are disc-shaped, watch-type lithium-ion batteries of the type commonly used in a wide variety of small electrical appliances.

The batteries 120, 122, are preferably designed to have a long lifespan as they are not replaceable. Fortunately, because of the low-current draw of LED type lights, two relatively inexpensive watch type batteries 120, 122 can be provided that have a commercially acceptable lifespan while still having a commercially acceptable low cost, to enable the flashlight 50 or other electrical device to be affordable to produce.

The switch member assembly 150 includes a plurality of interconnected parts. The first switch conductor 134 is generally ribbon-like and has a proximal end 136 and a distal end 138. The proximal end 136 is sized and positioned to engage the first terminal 124 of the battery by laying against the first terminal 124. The distal end 138 of the first switch conductor 134 includes a coupler 164 which couples with the first bulb conductor 142 of the lightbulb 146. Preferably, the lightbulb 146 is an LED bulb. The first switch conductor 134 and first bulb conductor 142 conduct current between the batteries 120, 122 and the lightbulb 146.

A switch member assembly 150 is provided that includes a proximal end 152 that contains the switch member 156 and a distal end 158 that is coupled to the lightbulb 146. The switch member 156 is formed of a conductive material. The switch member 156 is preferably stamped from a unitary piece of sheet-like conductive material 187, such as metal, and the stamping imparts the switch member 156 with the shape shown in the drawings along with the fold-line creases and other characteristics that are described in more detail hereinafter.

The switch member 156 includes a first leg 162 that includes a coupler 165 for receiving the second bulb conductor 166 to electrically couple the switch member 156 to the LED lightbulb 146. This first leg 162 is conductive (e.g., permits the passage of electricity therethrough). A second leg 170 is disposed 180 degrees from the first leg 162. The second leg 170 includes an angled leg portion 172. The angled leg portion 172 extends outwardly from the terminal engaging deformable central portion 178. The angled leg portion 172 is depicted as including a first portion 171 that is located generally co-planar with the retained portion 161 and a second portion 173 which is disposed at an angle relative the first portion 171. This second leg 170 is configured to deform and can be actuated by pressing downwardly on the angled leg portion 172 to actuate the switch by pressing downwardly to move the switch member 156 between its "on" position and its "off" position.

Turning now to FIG. 1, the second leg 170 is positioned under the top cover 28 generally under the off-printed designation 42 on the top cover member 28.

Turning now to FIGS. 5-13, a fold line 174 is located between the first portion 171 and the second portion 173 of the angled leg portion 172. The first portion 171 of the angled leg portion 172 is disposed radially inwardly of the fold line 174. The first portion 171 is coupled to the retained portion 161 of the switch and is disposed in a parallel plane thereto. The fold line 174 should be designed to fixedly position the second portion 173 with regard to the more radially, inwardly directed first portion 171 of the second leg 170, so that the oblique angle is maintained throughout the lifespan of the switch member 156.

The switch member 156 also includes a pair of opposed first and second side support legs 186, 188. As is best shown in FIG. 6, the switch member 156 has a cross-like/plus-sign-like shape with the first support leg 186 and the second support leg 188 extending on a line 181, which defines a first "cross" member of the cross-like/plus-sign-like shape. The line 181 is generally normal to (e.g., generally perpendicular to) a line 183 on which the first leg 162, second conductor 163, and second leg 170 (e.g., which includes the angled leg portion 172) are disposed, defining the cross-like/plus-sign-like shape. The switch member 156 includes four legs, with the first support leg 186 and the second support leg 188 comprising the third and fourth legs of the switch member 156.

The switch member 156 comprises the terminal engaging deformable central portion 178. At least a portion of the terminal engaging central portion 178 is deformable. For clarity, the terminal engaging deformable central portion 178 will be discussed hereinafter as the deformable portion 178. The deformable portion 178 is depicted as having a disc-shaped form. The deformable portion 178 is contained within an annular, ring-like score line 180 that serves as a boundary and mechanical divider between the deformable portion 178 and the radially outwardly disposed retained portion 161 that surrounds the deformable portion 178. The deformable portion 178 is capable of deforming in an "oil canning" manner between an "on" position, such as is shown in FIG. 8 and an "on" position as shown in FIG. 9. In the "on" position, the deformable portion 178 of the switch member 156 is disposed so that the underside surface of the switch member 156 is disposed in an adjacent contacting overlaying relationship with the second terminal 126 of the battery stack 122, 124.

The switch member 156 and deformable portion 178 are shown in the "off" position in FIG. 9.

In FIG. 9 it will be noted that the deformable portion 178 is deformed to assume a dome-like configuration wherein the deformable portion 178 does not engage the second terminal 126 of the battery. In this configuration, the spatial separation between the deformable portion 178 and the second terminal 126 causes no electrical contact connection to exist between the second bulb conductor 166 and the lightbulb 146. This prevents current from flowing from the batteries 122, 124 to the lightbulb 146.

The movement of the deformable portion 178 between its "on" position (FIG. 8) and its "off" position (FIG. 9) occurs through a phenomenon known as "oil-canning". "Oil-canning" relates to the movement of a perceived flat surface due to the application of an external force. The "oil-canning" occurs and is caused by the unequal stretching of the material inside the surface of the panel while its perimeter is retained.

An example of "oil-canning" occurs during a home canning process where the cooking process involves a cooling step. During this cooling step, the metal lid of the glass jar (such as a Ball® Jar) is pulled or popped down to thus ensure that the lid has sealed to the jar.

Another example of "oil-canning" is found at its origin in lubricating oil cans that are actuated to discharge oil by the use of engaging the bottom deformable surface of an oil can and pushing down and releasing the oil can to push oil out of the can.

As shown in the present flashlight 10, the switch member 156 includes a deformable portion 178. The deformable portion 178 is depicted as having a generally circular form that is defined by the boundary that comprises an annular score line 180. The annular score line 180 comprises the "retained perimeter" of the "oil can". The retained portion 161 of the switch is the portion of the switch that is outside annular score line boundary 180.

Turning now to FIGS. 8 and 9, it will be noted that when in the "on" position (FIG. 8), that the second portion 173 of the angled leg portion 172 extends relatively more vertically than when the switch member 156 is in its "off" position as is shown in FIG. 9. As is shown in FIG. 9, when the switch member 156 is placed in the "off" position the second portion 173 of the angled leg portion 172 is closer to being parallel to an upper surface of the second terminal 126.

To actuate the switch member 156, one presses downwardly on the deformable portion 178 to move the deformable portion 178 from the "off" position (FIG. 9) to the "on"

position wherein the deformable portion 178 of the switch member 156 lays against and is in electrical contact with, the second terminal 126 of the batteries 122, 124.

Turning now to FIG. 1, it will be noted that the "on" position 40 is axially separated from the "off" indicator 42. When assembled, the deformable portion 178 is positioned under the "on" indicator 40 and the outwardly disposed angled leg portion 172 of the second leg 170 is positioned generally under the "off" indicator. The axially separation between the "on" 40 and "off" 42 indicators is generally similar or identical to the axial separation between the center of the deformable portion 178, and the outwardly disposed angled leg portion 172 of the second leg 162.

When the deformable portion 178 of the switch is placed adjacent to, and in electrical contact with, the second terminal 126 of the batteries 122, 124, and hence is in its "on" position, current flows in the circuit between the lightbulb 146, the first bulb conductor 142, the batteries 122, 124, the switch to cause the lightbulb 146 to become illuminated as is shown in FIG. 8.

If one places his or her finger over the imprinted "off" 42 of the top cover of the flashlight 10 to push the angled leg portion 172 down, the deformable portion 178 of the switch member 156 will "oil can" into its "off" position where it no longer makes electrical contact with the second terminal 126 of the batteries 122, 124. In this position, the circuit is "open" and therefore current cannot flow between the second bulb conductor 166, the lightbulb 146, and the second switch conductor 163. The second bulb conductor 166 is coupled to the first leg 162 of the switch member 156 and is electrically coupled to the second terminal 126 of the batteries 122, 124. A coupler 165 is provided for coupling the second conductor 134 the first leg 162 of the switch member 156 to the second bulb conductor 166.

The lightbulb 146 of the electrical assembly 118 is an appropriately chosen standard LED lightbulb. One advantage of using LED lightbulbs is that they have a very low current draw. Since they have a very low current draw, the lifespan of the battery 120, 122 is prolonged significantly when compared to incandescent, conventional flashlight bulbs. By having a low current draw, the useful life of the electrical device 10, such as the flashlight 10, is enhanced considerably, when compared to prior art devices that employed incandescent bulbs.

FIG. 7 is a sectional view taken along lines 7-7 of FIG. 1, and illustrates the interior of the device 10 and the components connected therein. It will be noted that the first cover 28 overlays the first stiffener 78. The first stiffener 78 overlays, and is preferably adhesively coupled to the core 50, so that the underside surface of the first stiffener 78 is in adhesive contact with the upper surface 56 of the core 50.

The underside surface 58 of the core 50 is in adhesive contact with and overlays the upper side surface 110 of the second stiffener 98. The second stiffener 98 underlays and is in the parallel plane with the second cover member 30. A cavity 190 is formed within the core 50 and is the cavity into which the electrical assembly 118 is placed.

The electrical assembly 118 includes a plurality of overlapping components. The first and second batteries 120, 122 are disposed at the middle of the "sandwich". The batteries are underlain by the first switch conductor 134 and are overlain by the switch member 156 and, more particularly, the deformable portion 178 of the switch member 156.

FIGS. 10 and 11 show an alternate embodiment electrical assembly 200. The alternate embodiment electrical assembly 200 is generally similar to the electrical assembly 118 that is shown in FIGS. 1-9. The primary difference is that a casing 202 is provided to contain the electrical assembly 200, to thereby help protect the electrical 200 from damage.

This casing 202 helps to increase the useful life span of the electrical assembly along with increasing the reliability of devices into which it is placed, since it helps to protect the electrical assembly 200 from being damaged during the manufacturing process. Additionally, the covered assembly 200 that includes the casing 202 works well in devices that have different types of housing, such as flashlights, and other electrical devices including buzzers, etc. that have solid acrylic handled portions, rather than flexible plastic sheets, shown in FIGS. 1-9.

The plastic casing 202 is preferably comprised of a thin plastic material that includes a top cover portion 208 and a bottom cover portion 210. The top cover portion 208 includes a relatively proximally disposed sheet-like disc-shaped portion 214 that is sized to have a diameter just slightly larger than the diameter of the batteries 120, 122. A finger-like member 212 extends outwardly from the disc-shaped portion 214 and is sized to have a length that is long enough to enable it to extend distally just beyond the tip of the lightbulb 146 and a width wide enough to extend just beyond the side edges of the lightbulb 146.

The disc-shaped portion 214 is designed primarily to protect the switch member 156 and conductors 134, 142, 166, and the finger-shaped portion 212 is designed primarily to protect the lightbulb 146. Preferably, the cover top portion and bottom portions 208, 210, along with the finger-shaped portion 212 are designed to be opaque. By using an opaque cover, the casing 202 can enable the user to control the direction of the light's output.

As shown in FIG. 10, there is a side portion which extends generally halfway around the distal perimeter of the batteries and which leaves the proximal end of the batteries exposed.

FIGS. 12 and 13 comprise additional CAD-type perspective views of the electrical assembly 118 (FIG. 12), and the switch member 156 (FIG. 13).

A maintained switch member 156 is provided for use with an electrical device 10 having an electrically powered member 146 and a power source 120, 122 having a first terminal 124 and second terminal 126. The switch member 156 is movable between a maintained "on" (FIG. 8) position and a maintained "off" position (FIG. 9). The switch member 156 includes a first switch conductor 134 configured for being coupled to the first terminal 124 and the electrically powered member 146. A switch member assembly 150 includes a first leg 162 that is configured for being coupled to the second terminal 126, and includes a deformable portion 178, and a retained portion 161. The deformable portion 178 is movable between a contacting position (FIG. 8) wherein it contacts the second terminal 126 of the power source 120, 122 and a non-contacting position (FIG. 9) wherein it is spatially separated from, and not in contact with the second terminal 126 of the power source 120, 122.

Having described the invention with regard to certain preferred embodiments, it will be appreciated that variations and modifications exist within the scope and spirit of the present invention and that the scope of protection is not to be limited to those specific embodiments shown herein.

What is claimed is:

1. A maintained switch assembly for use with an electrical device having an electrically powered member and a power source having a first terminal and a second terminal, the switch assembly being movable between a maintained "on" position and a maintained "off" position, the switch assembly comprising:

a first conductor configured for being coupled to the first terminal and the electrically powered member;

a switch member configured for being coupled to the second terminal, the switch member including a sheet-like terminal engaging central portion, and a retained portion;

wherein the sheet-like terminal engaging central portion includes a deformable portion;

an angled leg portion having a first portion disposed generally co-planar with the retained portion and a second portion disposed at an angle to the first portion and being configured such that pressing on the angled leg portion moves the deformable portion between a contacting position and a non-contacting position; and wherein, in the contacting position, the deformable portion contacts the second terminal of the power source and, in the non-contacting position, the deformable portion is spatially separated from, and not in contact with the second terminal of the power source.

2. The switch assembly of claim 1, further comprising an annular boundary separating the deformable portion from the retained portion, and wherein the retained portion surrounds the deformable portion.

3. The switch assembly of claim 1 wherein the switch includes first and second support legs.

4. The switch assembly of claim 3 further comprising a second conductor, wherein the second conductor extends generally co-linearly with the first portion of the angled leg portion.

5. The switch assembly of claim 4 wherein the first and second support legs extend on a line that is generally normal to a line on which the second conductor and angled leg portion are disposed.

6. The switch assembly of claim 4 wherein the second conductor is coupled to the retained portion and includes a coupler for coupling the second conductor to the electrically powered member.

7. The switch assembly of claim 6, wherein the electrical device comprises a flashlight and the electrically powered member comprises a lightbulb.

8. The switch assembly of claim 1 further comprising a second conductor formed as a part of the switch member.

9. The switch assembly of claim 1 wherein the angled leg portion is formed as a part of the switch member.

10. The switch assembly of claim 9 wherein the angled leg portion includes a first portion disposed generally co-planar with the retained portion and a second portion disposed at an oblique angle to the first portion.

11. The switch assembly of claim 1 wherein the switch member includes a second conductor, wherein the angled leg portion generally extends toward a proximal end of the switch assembly, wherein the second conductor extends toward a distal end of the switch assembly, and wherein the switch member further includes a first support leg and a second support leg.

12. The switch assembly of claim 11 wherein the deformable portion is generally disc-shaped, a circular boundary member separates the deformable portion from the retained portion, and the second conductor, angled leg portion, first support leg, and second support leg are stamped from a single sheet of conductive material.

13. The switch assembly of claim 1 wherein the electrical device with which the switch is configured to be used is a flashlight and the electrically powered member is a light bulb.

14. An electrically powered device comprising a body having a length, a width smaller than the length, a depth smaller than the width, and a pliable cover;

an electrical assembly including a power source having a first terminal and a second terminal, an electrically powered member, and a maintained switch being movable between a maintained "on" position and a maintained "off" position, the switch comprising:

a first conductor configured for being coupled to the first terminal and the electrically powered member;

a unitarily formed switch member configured for being coupled to the second terminal, the switch member including a sheet-like terminal engaging central portion and a retained portion, wherein the sheet-like terminal engaging central portion includes a deformable portion;

an angled leg portion having a first portion disposed generally co-planar with the retained portion and a second portion disposed at an angle to the first portion and being configured such that pressing on the angled leg portion moves the deformable portion between a contacting position and a non-contacting position; and wherein, in the contacting position, the deformable portion contacts the second terminal of the power source, in the non-contacting position, the deformable portion is spatially separated from, and not in contact with the second terminal of the power source.

15. The electrically powered device of claim 14 wherein the switch member includes a second conductor, an angled leg that extends generally co-linearly with the second conductor, a first support leg and a second support leg, wherein the deformable portion is generally disc-shaped, and a circular boundary member separates the deformable portion from the retained portion, and wherein the second conductor, angled leg, first support leg, second support leg, deformable portion and retained portion are unitarily formed from a single sheet of conductive material.

* * * * *